US010823400B2

(12) United States Patent
Zhang et al.

(10) Patent No.: US 10,823,400 B2
(45) Date of Patent: Nov. 3, 2020

(54) MULTI-CAVITY GAS AND AIR MIXING DEVICE

(71) Applicant: A. O. Smith Corporation, Milwaukee, WI (US)

(72) Inventors: Shiping Zhang, Nanjing (CN); Dayan Bi, Nanjing (CN); Ruihong Wei, Nanjing (CN)

(73) Assignee: A.O. SMITH CORPORATION, Milwaukee, WI (US)

( * ) Notice: Subject to any disclaimer, the term of this patent is extended or adjusted under 35 U.S.C. 154(b) by 0 days.

(21) Appl. No.: 15/110,377

(22) PCT Filed: Jan. 9, 2014

(86) PCT No.: PCT/CN2014/070374
§ 371 (c)(1),
(2) Date: Jul. 7, 2016

(87) PCT Pub. No.: WO2015/103754
PCT Pub. Date: Jul. 16, 2015

(65) Prior Publication Data

US 2016/0334100 A1 Nov. 17, 2016

(51) Int. Cl.
*F23D 14/04* (2006.01)
*F23D 14/62* (2006.01)
*F23D 14/64* (2006.01)

(52) U.S. Cl.
CPC ..... *F23D 14/04* (2013.01); *F23D 14/62* (2013.01); *F23D 14/64* (2013.01); *F23D 2203/007* (2013.01)

(58) Field of Classification Search
CPC ..... F23D 14/04; F23D 14/62; F23D 14/64
(Continued)

(56) References Cited

U.S. PATENT DOCUMENTS 6,000,933 A * 12/1999 Frederick, Sr. ..... F23D 14/64 126/110 R
2006/0035183 A1* 2/2006 Carroni ..... B01F 5/0057 431/7

(Continued)

FOREIGN PATENT DOCUMENTS

CN 1497211 5/2004
CN 2722046 8/2005

(Continued)

OTHER PUBLICATIONS

First Office Action from The State Intellectual Property Office of China for Application No. 201410009996.2 dated Sep. 25, 2015 (7 pages)

(Continued)

*Primary Examiner* — Steven B Mcallister
*Assistant Examiner* — Allen R Schult
(74) *Attorney, Agent, or Firm* — Michael Best & Friedrich LLP

(57) ABSTRACT

A multi-cavity gas-air mixing device includes at least two mixing cavities each having an air inlet and a mixture outlet communicated with a combustor, wherein each of the mixing cavities has a built-in gas pipeline, each of the gas pipelines is provided with a gas jet, and the orientation of the gas jet is intersected with a flow direction of air entering into the mixing cavities. The device effectively segments the gas-air mixer and achieves a large load regulation ratio, without producing condensate water at any load segment, thereby improving the system reliability and service life. The built-in gas pipeline not only actively controls the fuel in the open-close control pipeline, but also reduces the volume of the mixer and largely decreases the cost.

11 Claims, 3 Drawing Sheets

(58) Field of Classification Search
USPC ..... 431/354
See application file for complete search history.

(56) References Cited

U.S. PATENT DOCUMENTS

| | | | | |
|---|---|---|---|---|
| 2013/0224670 | A1* | 8/2013 | Zatti | F23D 14/02 431/38 |
| 2013/0294192 | A1* | 11/2013 | Son | B01F 3/028 366/182.4 |
| 2015/0056564 | A1* | 2/2015 | Yu | F23D 14/46 431/354 |
| 2015/0064637 | A1* | 3/2015 | Yu | F23N 3/06 431/354 |
| 2015/0086931 | A1* | 3/2015 | Kim | F23D 14/60 431/181 |

FOREIGN PATENT DOCUMENTS

| | | | |
|---|---|---|---|
| CN | 103196218 | | 7/2013 |
| CN | 203628660 | | 6/2014 |
| JP | H0618013 | | 1/1994 |
| JP | H0875127 | | 3/1996 |
| JP | H1089627 | | 4/1998 |
| JP | 10227413 | A * | 8/1998 |
| JP | H10227413 | | 8/1998 |

OTHER PUBLICATIONS

Second Office Action from The State Intellectual Property Office of China for Application No. 201410009996.2 dated Feb. 15, 2016 (7 pages).
International Search Report for International Application No. PCT/CN2014/070374 dated Oct. 15, 2014 (2 pages).
Search Report from The State Intellectual Property Office of China for Application No. 201410009996.2 undated (4 pages).

* cited by examiner

MULTI-CAVITY GAS AND AIR MIXING DEVICE

TECHNICAL FIELD

The present invention relates to a multi-cavity gas-air mixing device applicable to a fully-premixed combustion gas water heater, in particular a mixer capable of realizing a sectionalized combustion function, which belongs to the technical field of water heater.

BACKGROUND

The fully-premixed combustion system means a system that performs a combustion after evenly mixing gas and air at one time, characterized in the advantages such as a small excess air coefficient (i.e., a ratio of the actually required amount of air to the theoretically required amount of air is usually less than 1.5), a low pollutant (NOx, CO) emission, a large combustion intensity, a short flame, a high combustion area thermal load, and weak combustion noise. In the field of gas water heater, the fully-premixed combustion system has been applied with a certain history, and its development is optimistic with the improvement of various performance requirements, in particular, the increasingly strict control of pollutant emission by the nation.

However, the existing fully-premixed combustion system is not applicable to the non-condensed product. The fully-premixed combustor is very different from the common partially-premixed combustor, and it is usually made of ceramics, stainless steel plate, carbon fiber plate, iron chromium aluminum wire mesh, etc., characterized in that the combustion is sufficient at a low excess air coefficient; meanwhile, since little air is supplied for combustion, the flame temperature is higher than that of the partially-premixed combustion for about 300° C. The higher flue gas temperature and the less flue gas amount (excess air coefficient) greatly improve the heat exchange efficiency, which can easily produce condensate water, thus the fully-premixed combustion mode is usually used for the condensate combustion system.

Assuming that the probability of condensate water production is P, then $$P=f(Q,A,\alpha).$$

Wherein Q is an input load, A is an effective heat exchange area of a heat exchanger, and a is an excess air coefficient.

As to a water heater working normally, the value of A is fixed, and the above equation may be simplified as $P=f(Q,\alpha)$. That is, the probability of condensate water production is determined by the excess air coefficient and the input load of the system: 1) when the input load changes linearly in a certain range, as the load decreases, the relative heat exchange area increases, the heat exchange efficiency improves, and the probability of condensate water production rises; as to a determined combustion system, when the excess air coefficient is constant, condensate water certainly occurs if the input load decreases to a certain value. 2) The excess air coefficient is directly related to the condensate water production. Generally speaking, the dew point temperature Td is an important parameter to evaluate whether condensate water will be produced. Condensate water is certainly produced when the flue gas temperature is lower than the dew point temperature. The flue gas dew point is proportional to the flue gas moisture content (ds) that is equal to a ratio of water steam mass in the flue gas to a total flue gas mass. Obviously, as the excess air coefficient improves, the total flue gas mass increases, and as the flue gas moisture content decreases, the flue gas dew point temperature declines, and the probability of condensate water production is lowered. Thus, in order to prevent the condensate water production for the non-condensed product, the settlement shall be made from the above two aspects.

As to the conventional partially-premixed combustion, the combustion system usually consists of several independent combustors, and the regulation between the maximum and minimum loads can be completed by turning on and off a few of combustors. As illustrated in FIG. 1, which is a characteristic diagram of an existing partially-premixed sectionalized combustion, wherein transverse coordinate I is a regulated current value, vertical coordinate Q is an input load, and a system totally having 15 combustors is divided into segment 1 (the number of combustors is n1=5) and segment 2 (the number of combustors is n2=15), thereby largely increasing the regulation ratio of the system. Under the maximum load, all the combustors work, and the excess air coefficient is usually about 2. Under the minimum load, only a few of combustors work and other combustors just allow air to pass through, and the excess air coefficient can be more than 10. Thus the probability of condensate water production by the system is very low.

But as to the fully-premixed combustion, in the whole load range, its excess air coefficient is always remained at about 1.5, and a flame floating will be caused when the excess air coefficient is too high, while a flameout or a flareback will be caused when the excess air coefficient is too low, thus the probability of condensate water production under a small load is greatly increased. The experimental results show that as to a heat exchange system of a fixed type, the probability of condensate water production will not be decreased unless the excess air coefficient is more than 2. Thus, how to apply the fully-premixed combustion system into the non-condensed product without the risk of condensate water production is one of the problems to be solved by the present invention.

A Chinese patent with an application No. 200310101740 and an invention title Multistage Controllable Gas Combustor discloses a multistage controllable gas combustor that consists of a plurality of independent tube-type combustors each having a mixture supply device therein, and a Venturi tube and a manifold are provided outside the mixture supply device to control supply and mixing of the gas and air, respectively. Although the invention solves the problem of segmentation, the structure is complex, the volume is huge, the requirements of manufacturing and assembling processes are strict, and the cost is also high.

Another Chinese patent with an application No. 201310135997 and an invention title Positive-Pressure-Injecting Type Fully-Premixed Combustion Heating Device also discloses a similar structure.

In conclusion, it is a meaningful work to develop a prefixed combustion system which can be segmented, have a large load range, does not easily produce condensate water, have a compact size and a cheap cost, and be safe and reliable, while one of the key steps is to design an excellent gas/air combustor.

SUMMARY

The object of the present invention is to provide a multi-cavity gas-air mixing device, which can reduce the volume and sufficiently mix gas and air such that they are evenly distributed on the combustion cross section, and which also has the function of sectionalized combustion such that no condensate water is produced in the heat exchanger under a small load, thereby prolonging the service life of the system.

In order to achieve the above object, the present invention proposes a multi-cavity gas-air mixing device, comprising at least two mixing cavities each having an air inlet and a mixture outlet communicated with a combustor, wherein each of the mixing cavities has a built-in gas pipeline, each of the gas pipelines is provided with a gas jet, and the orientation of the gas jet is intersected with a flow direction of air entering into the mixing cavities.

In the aforementioned multi-cavity gas-air mixing device, the gas pipelines in the at least two mixing cavities are communicated with each other and the communicated gas pipelines comprise at least one open-close control pipeline.

In the aforementioned multi-cavity gas-air mixing device, the communicated gas pipelines further comprise at least one normally open pipeline connected to an external gas delivery pipeline, and a gas on-off valve that controls the open-close control pipeline to be opened and closed is provided between the open-close control pipeline and the normally open pipeline.

In the aforementioned multi-cavity gas-air mixing device, the gas on-off valve is a solenoid valve having a sealing part movably blocking between the open-close control pipeline and the normally open pipeline.

In the aforementioned multi-cavity gas-air mixing device, the gas pipeline is provided as being perpendicular to an air flow path of the mixing cavity.

In the aforementioned multi-cavity gas-air mixing device, the mixing cavity is of Venturi type, and the Venturi type mixing cavity has a convergent throat segment and a divergent mixing segment.

In the aforementioned multi-cavity gas-air mixing device, the at least two mixing cavities are arranged in parallel, the two adjacent mixing cavities are partitioned from each other through a partition board, and the gas pipeline is provided throughout the mixing cavities through a mounting hole opened on the partition board.

In the aforementioned multi-cavity gas-air mixing device, a distribution structure is provided at an upper portion of the mixing cavity.

In the aforementioned multi-cavity gas-air mixing device, the distribution structure is a flat plate having a porous structure.

In the aforementioned multi-cavity gas-air mixing device, the at least two mixing cavities comprise a first mixing cavity in which a first gas pipeline is provided, and a second mixing cavity in which a second gas pipeline is provided, the first gas pipeline and the second gas pipeline are communicated with each other and each provided with the gas jet, and the gas on-off valve is provided between the first gas pipeline and the second gas pipeline.

In the aforementioned multi-cavity gas-air mixing device, a ratio of a sum of areas of the gas jets on the first gas pipeline to a sum of areas of the gas jets on the second gas pipeline is between 1:3 and 1:1.

As compared with the prior art, the present invention has the following characteristics and advantages:

1. The present invention effectively segments the gas-air mixer through a plurality of mixing cavities and achieves a large load regulation ratio, without producing condensate water at any load segment, thereby improving the system reliability and service life.

2. The built-in gas pipeline of the present invention not only actively controls the fuel in the open-close control pipeline, but also reduces the volume of the mixer and largely decreases the cost.

3. The orientation of the gas jet of the present invention is intersected with a flow direction of air entering into the mixing cavities, such that gas and air are sufficiently mixed.

In conclusion, as compared with the prior art, the present invention solves the problem that the conventional fully-premixed combustion system cannot be segmented, uses a structure where the gas pipeline is built in the mixer, and effectively controls the fuel supply of the open-close control pipeline through the gas on-off valve, thus the structure is compact, the cost is low, and the safety is high, thereby having prominent substantive features and representing a notable progress.

BRIEF DESCRIPTION OF THE DRAWINGS

The accompanying drawings introduced herein are just for the purpose of explanation, rather than restricting the scope of the disclosure of the present invention. In addition, the shapes and scales of various parts in the accompanying drawings are just schematic to promote the understanding of the present invention, rather than restricting the shapes and scales of those parts in the present invention. Being taught by the present invention, a person skilled in the art can implement the present invention by selecting various possible shapes and scales according to the specific conditions.

DESCRIPTION OF THE REFERENCE NUMERALS

1 first mixing cavity;
11 first air inlet;
12 first gas pipeline;
2 second mixing cavity;
21 second air inlet;
22 second gas pipeline;
3 third mixing cavity;
32 third gas pipeline;
4 gas jet;
5 gas on-off valve;
501 sealing part;
51 first solenoid valve;
52 second solenoid valve;
6 partition board;
7 throat segment;
8 mixing segment.

DESCRIPTION OF THE EMBODIMENTS

The details of the present invention will be clearer in conjunction with the accompanying drawings and the embodiments of the present invention. However, the embodiments of the present invention described herein are just for the purpose of explanation of the present invention, rather than being construed as restrictions to the present invention in any way. Being taught by the present invention, a person skilled in the art can conceive any possible modification based on the present invention, which shall be deemed as falling within the scope of the present invention.

The present invention proposes a multi-cavity gas-air mixing device, comprising at least two mixing cavities each having an air inlet, a mixture outlet communicated with a combustor, and a built-in gas pipeline, which reduces the entire volume of the mixing device. Each gas pipeline is provided with a gas jet and the orientation of the gas jet is intersected with a flow direction of air entering into the mixing cavities. Thus air and gas are sufficiently mixed in the mixing cavity.

Figure 1:
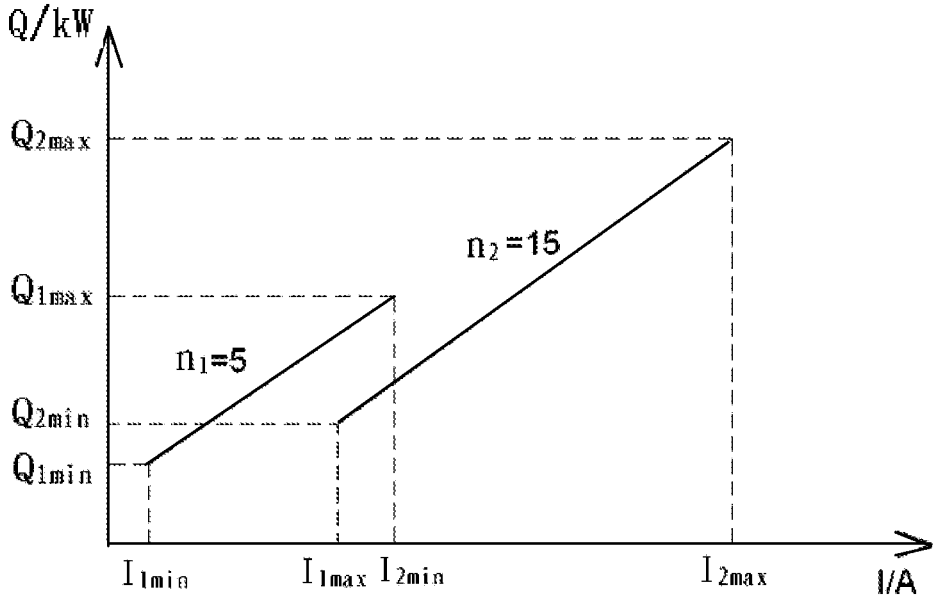
FIG. 1 is a characteristic diagram of an existing partially-premixed sectionalized combustion.
Figure 2:
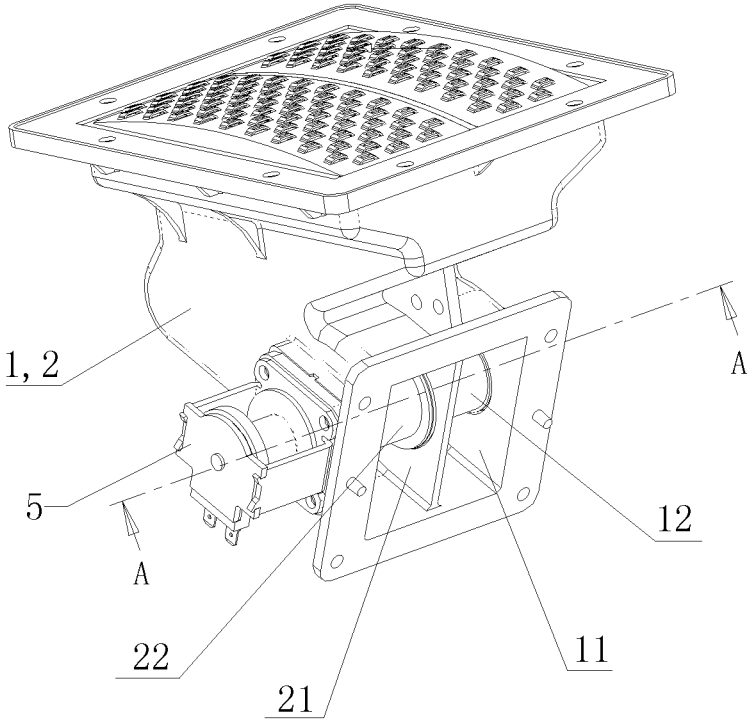
FIG. 2 is a stereo structure schematic diagram of Embodiment 1 of a multi-cavity gas-air mixing device of the present invention.
Figure 3:
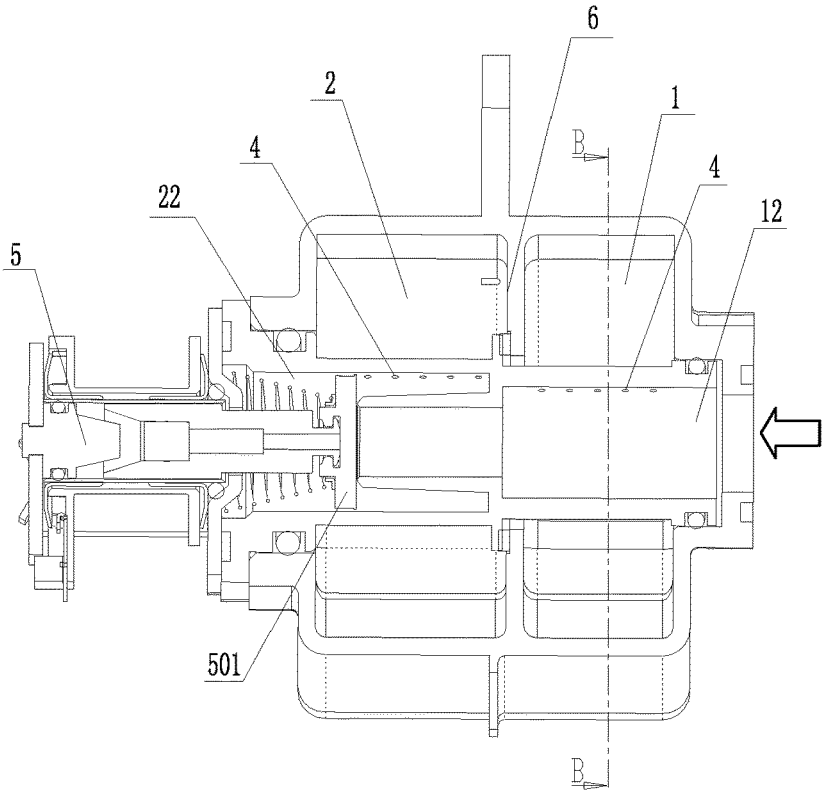
FIG. 3 is a structure schematic diagram of cross-section A-A of FIG. 2.
Figure 4:
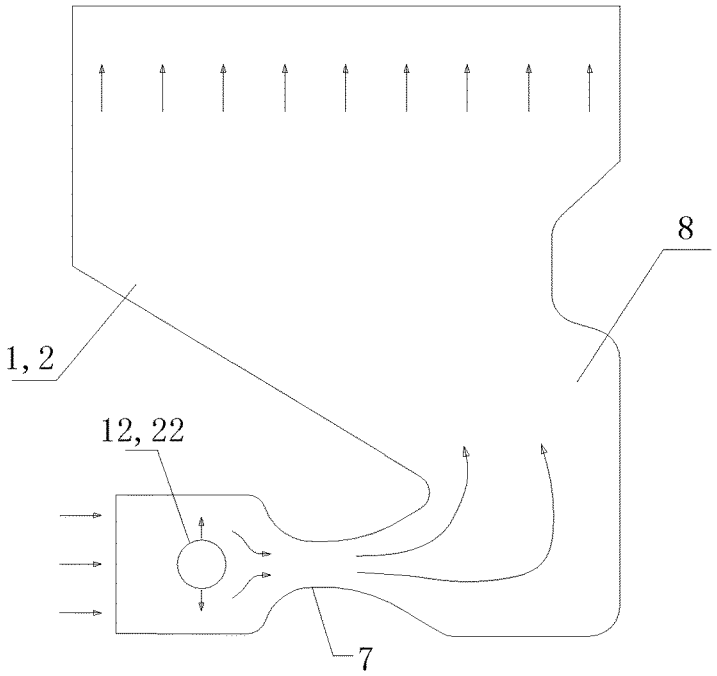
FIG. 4 is a structure schematic diagram of cross-section B-B of FIG. 3.

As illustrated in FIGS. 2 to 4, FIG. 2 is a stereo structure schematic diagram of Embodiment 1 of a multi-cavity gas-air mixing device of the present invention, FIG. 3 is a structure schematic diagram of cross-section A-A of FIG. 2, and FIG. 4 is a structure schematic diagram of cross-section B-B of FIG. 3. The multi-cavity gas-air mixing device of the present invention comprises: a first mixing cavity 1, a second mixing cavity 2, a first air inlet 11, a second air inlet 21, a first gas pipeline 12, a second gas pipeline 22, a gas on-off valve 5, and a mixture outlet (not illustrated). The first mixing cavity 1 has an air inlet 11 and a mixture outlet, and the second mixing cavity 2 has an air inlet 21 and a mixture outlet, wherein the air inlet 11, 21 is communicated with atmosphere to supply air through a fan, such that external air enters the mixing cavity 1, 2 and flows along an air passage formed by an inner cavity of the mixing cavity. The mixture outlet is connected to the combustor to supply mixture to the mixing cavity. As illustrated in FIGS. 2 and 3, the first mixing cavity 1 has a built-in first gas pipeline 12 with one end connected to a gas delivery pipeline and a gas regulating valve (the arrow in FIG. 3 indicating a gas input direction) that controls the amount of gas introduced into the first gas pipeline 12, and the other end connected to a second gas pipeline 22 built in the second mixing cavity 2 such that the gas can be delivered to the second gas pipeline 22 through the first gas pipeline 12. The first gas pipeline 12 and the second gas pipeline 22 each has a gas jet 4. Gas is jetted into the mixer by the gas jet 4 provided in the gas pipeline of the mixer, and the orientation of the gas jet 4 is intersected with a flow direction of air entering into the mixing cavity 1, 2, such that the gas flow in the mixing cavity 1, 2 is intersected and mixed with the air flow. The gas flow changes its direction after the mixing and flows with the air flow, which increases the actual length of a gas-air mixing path in the mixing cavity 1, 2, thereby sufficiently mixing gas and air while reducing the entire volume of the device. Of course, the present invention can also arrange three, four or more mixing cavities in parallel, provided that the gas flow in the mixing cavity 1, 2 is intersected and mixed with the air flow.

Further, the gas pipeline 12 is provided as being perpendicular to the air flow path of the mixing cavity 1, and the gas pipeline 22 is provided as being perpendicular to the air flow path of the mixing cavity 2, such that the gas and air are mixed more sufficiently, and the entire volume of the combustor is further reduced.

In this embodiment, as illustrated in FIGS. 2 and 3, the first gas pipeline 12 and the second gas pipeline 22 are communicated with each other, and a gas on-off valve 5 that controls the second gas pipeline 22 to be opened and closed is provided between the first gas pipeline 12 and the second gas pipeline 22. The first gas pipeline 12 is a normally open pipeline, i.e., it is remains a normally open state, and the second gas pipeline 22 is an open-close control pipeline, i.e., its opening or close is controlled through the gas on-off valve 5 to realize a sectionalized combustion function. Thus, not only the load regulation ratio of the system is increased, but also the probability of condensate water production by the flue gas is efficiently reduced. In the present invention, three, four or more gas pipelines may also be adaptively provided depending on the number of the mixing cavities. The gas pipelines are orderly communicated, including at least one open-close control pipeline and at least one normally open pipeline. The normally open pipeline is connected to the external gas delivery pipeline, and a connection pipe of the open-close control pipeline is provided with a gas on-off valve that controls the open-close control pipeline to be opened or closed.

Further, as illustrated in FIGS. 2 and 3, in this embodiment the gas on-off valve 5 is a solenoid valve, which has a sealing part 501 movably provided between the first gas pipeline 12 and the second gas pipeline 22 from an outer side of the second gas pipeline 22 to block the inlet of the second gas pipeline 22, so as to realize a closing function of the second gas pipeline 22. When the second gas pipeline 22 is to be opened, it only needs to move the sealing part 501 to one side of the second gas pipeline 22 such that the first gas pipeline 12 and the second gas pipeline 22 are communicated with each other again. In the present invention, the gas on-off valve 5 may also be a stop valve, a ball valve, a butterfly valve, a plunger valve or any other known switch valve provided that the opening and closing function of the open-close control pipeline can be realized, which is not limited herein.

Further, a ratio of a sum of areas of the gas jets 4 on the first gas pipeline 12 to a sum of areas of the gas jets 4 on the second gas pipeline 22 is between 1:3 and 1:1.

Further, as illustrated in FIGS. 2 and 3, the first mixing cavity 1 and the second mixing cavity 2 are partitioned from each other through a partition board 6, and the first gas pipeline 12 and the second gas pipeline 22 are provided throughout the first mixing cavity 1 and the second mixing cavity 2 through mounting holes opened on the partition board 6, such that the structure is more compact.

Further, distribution structures are provided at upper portions of the first mixing cavity 1 and the second mixing cavity 2, such that the mixture is evenly delivered to the combustor through the distribution structures. Preferably, the distribution structure is a flat plate having a porous structure.

Further, as illustrated in FIG. 4, the first mixing cavity 1 and the second mixing cavity 2 are of Venturi type. The Venturi type mixing cavity 1, 2 has a convergent throat segment 7 and a divergent mixing segment 8. In this embodiment, the gas jets 4 are located at the front side of the Venturi throat segment 7. The gas and air are firstly mixed in the region that is the front side of the Venturi throat segment 7, then diffused downstream the throat segment 7 after being compressed and accelerated by the throat segment 7, prefixed at a subsequent large radian corner of the Venturi type mixing cavity and several places where the flow channel is deformed, and sufficiently mixed before reaching the combustor, so as to ensure a sufficient combustion and a low pollutant emission.

Figure 5:
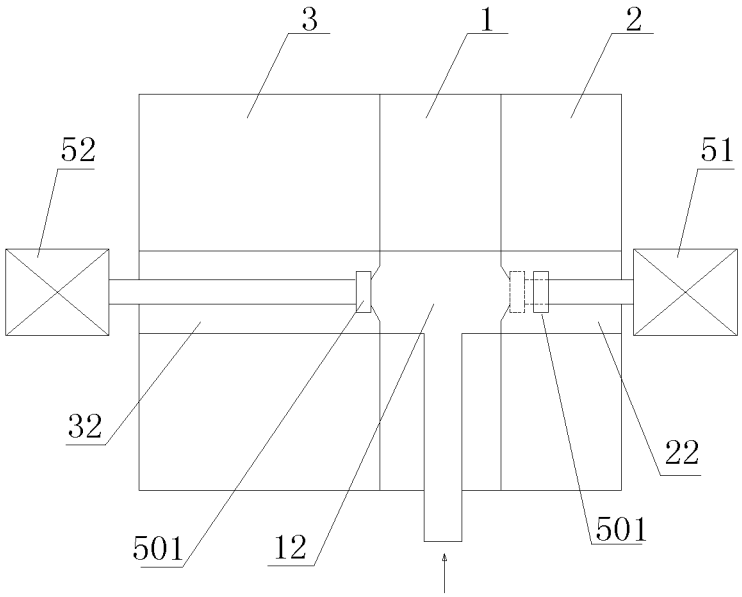
FIG. 5 is a structure schematic diagram of Embodiment 2 of a multi-cavity gas-air mixing device of the present invention.

Another optional embodiment of the present invention is illustrated in FIG. 5, which is a structure schematic diagram of Embodiment 2 of a multi-cavity gas-air mixing device of the present invention. This embodiment differs from Embodiment 1 in that the mixing cavity may be further divided into a first mixing cavity 1, a second mixing cavity 2 and a third mixing cavity 3, and the device further comprises an air inlet, a first gas pipeline 12, a second gas pipeline 22, a third gas pipeline 32, a first solenoid valve 51, a second solenoid valve 52, and a mixture outlet. In which, the first gas pipeline is connected to the second gas pipeline 22 and the third gas pipeline 32, respectively, and a gas sealing platform is provided at the joint to control the second gas pipeline 22 and the third gas pipeline 32 to be opened and closed through engagement and disengagement between the sealing part 501 of the solenoid valve 51, 52 and the gas sealing platform. Through the structure design of the embodiment, the mixing device may be divided into three segments, thereby further increasing the combustion load regulation ratio and being more beneficial to the high power system.

The multi-cavity gas-air mixing device of the present invention may be manufactured in a way of integral molding, and the material may be aluminum or plastics such as PPS.

In conclusion, the present invention integrates the gas injection device with the mixer, such that the gas-air mixer has the function of sectionalized combustion and the efficiency is high under a large load, thereby not only increasing the load regulation ratio of the system, but also efficiently reducing the probability of condensate water production by the flue gas because no condensate water is produced under a small load. Meanwhile, the gas pipeline is built in the mixer such that gas and air are mixed more sufficiently and evenly, which efficiently reduces the combustion pollutant emission, optimizes the size of the mixer, and achieves the purpose of decreasing the system volume, thereby largely reducing the total cost and representing a notable technical progress.

The detailed descriptions of the above embodiments are just used to explain the present invention for a better understanding. But those descriptions cannot be construed as limitations to the present invention in any reason, in particular, the features described in different embodiments can be combined arbitrarily to form other embodiments. Unless otherwise specified explicitly, those features shall be understood as being applicable to any embodiment rather than those described.

What is claimed is:

1. A multi-cavity gas-air mixing device, comprising at least two mixing cavities each having an air inlet and a mixture outlet communicated with a combustor, wherein each of the mixing cavities has a built-in gas pipeline inside, each of the gas pipelines is provided with a gas jet, and the orientation of each gas jet is intersected with a flow direction of air entering into the mixing cavities and the air flow flows over the gas pipelines, and wherein the gas pipelines in the at least two mixing cavities are communicated with each other inside the mixing cavities and the communicated gas pipelines comprise at least one open-close control pipeline, and wherein the communicated gas pipelines further comprise at least one normally open pipeline connected to an external gas delivery pipeline, and a gas on-off valve that controls the open-close control pipeline to be opened and closed is provided between the open-close control pipeline and the normally open pipeline, and the gas on-off valve is positioned at least partially within one of the mixing cavities, and the normally open pipeline has an extension section extending into an interior of the open-close control pipeline and provided with a gas outlet which is in communication with the open-close control pipeline and is controlled by the gas on-off valve to be opened and closed.

2. The multi-cavity gas-air mixing device according to claim 1, wherein the gas on-off valve is a solenoid valve having a seal movably blocking between the open-close control pipeline and the normally open pipeline.

3. The multi-cavity gas-air mixing device according to claim 1, wherein the gas pipeline is provided as being perpendicular to an air flow path of the mixing cavity.

4. The multi-cavity gas-air mixing device according to claim 1, wherein the mixing cavity is of Venturi type, and the Venturi type mixing cavity has a convergent throat segment and a divergent mixing segment.

5. The multi-cavity gas-air mixing device according to claim 1, wherein the at least two mixing cavities are arranged in parallel, the two adjacent mixing cavities are partitioned from each other through a partition board, and the gas pipeline is provided throughout the mixing cavities through a mounting hole opened on the partition board.

6. The multi-cavity gas-air mixing device according to claim 1, wherein a distributor through which the mixture is evenly delivered to the combustor is provided at an upper portion of the mixing cavity.

7. The multi-cavity gas-air mixing device according to claim 6, wherein the distributor is a flat plate having a porous structure.

8. The multi-cavity gas-air mixing device according to claim 1, wherein the at least two mixing cavities comprises a first mixing cavity and a second mixing cavity; the built-in gas pipeline of the first mixing cavity is the normally open pipeline and the built-in gas pipeline of the second mixing cavity is the open-close control pipeline.

9. The multi-cavity gas-air mixing device according to claim 8, wherein the gas jet on each of the normally open and the open-close control pipelines comprises a plurality of gas jets, and a ratio of a sum of areas of the plurality of gas jets on the normally open pipeline to a sum of areas of the plurality of gas jets on the open-close control pipeline is between 1:3 and 1:1.

10. The multi-cavity gas-air mixing device according to claim 1, wherein the open-close control pipeline and the normally open pipeline are coaxial with each other about a longitudinal axis.

11. The multi-cavity gas-air mixing device of claim 10, wherein the gas outlet is in a plane perpendicular to the longitudinal axis and the gas on-off valve moves axially along the longitudinal axis to close the gas outlet.

* * * * *